United States Patent [19]

Hall et al.

[11] 4,392,703

[45] Jul. 12, 1983

[54] ELECTRICAL CONDUCTOR HAVING AN INTEGRAL ELECTRICAL CONTACT

[75] Inventors: James R. Hall, Bainbridge; William P. Whallon, Jr., Unadilla, both of N.Y.

[73] Assignee: The Bendix Corporation, Southfield, Mich.

[21] Appl. No.: 269,134

[22] Filed: Jun. 1, 1981

Related U.S. Application Data

[62] Division of Ser. No. 90,198, Nov. 1, 1979, abandoned, which is a division of Ser. No. 890,339, Mar. 27, 1978, Pat. No. 4,206,958.

[51] Int. Cl.[3] ..... H01R 13/28; H01R 11/11

[52] U.S. Cl. ..... 339/49 R; 339/211; 339/278 T

[58] Field of Search ..... 339/47, 48, 49, 252, 339/276 R, 276 T, 278, 100, 244, 250, 211; 29/861, 862, 874, 882; 174/84 C, 90

[56] References Cited

U.S. PATENT DOCUMENTS

| | | | |
|---|---|---|---|
| 536,153 | 3/1895 | McEvoy | 339/148 |
| 600,058 | 3/1898 | Bournonville | 339/148 |
| 1,377,439 | 5/1921 | Rice | 339/29 R |
| 1,855,340 | 4/1932 | Damon | 174/90 |
| 3,111,554 | 11/1963 | Harris | 174/90 |
| 3,255,430 | 6/1966 | Phillips | 339/252 R |
| 3,284,754 | 11/1966 | Buchanan | 339/95 D |
| 3,333,609 | 8/1967 | Fielding | 174/87 |
| 3,404,369 | 10/1968 | Grove | 339/29 R |
| 3,471,904 | 10/1969 | Aho | 174/90 |
| 3,525,070 | 8/1970 | Berg | 339/276 T |
| 3,560,909 | 2/1971 | Wyatt et al. | 339/100 |
| 3,725,844 | 4/1973 | McKeown et al. | 339/49 R |
| 3,987,540 | 10/1976 | Gryctko | 174/90 |

FOREIGN PATENT DOCUMENTS

| | | | |
|---|---|---|---|
| 2405313 | 8/1974 | Fed. Rep. of Germany | 339/100 |
| 796862 | 4/1936 | France | 339/100 |
| 606990 | 7/1960 | Italy | 339/252 P |

*Primary Examiner*—Neil Abrams
*Attorney, Agent, or Firm*—Kenneth A. Seaman; Raymond J. Eifler; Charles D. Lacina

[57] ABSTRACT

An electrical conductor (10) having at forward end portion (F) of the conductor an integral electrical contact portion consisting of a plurality of fine, axially aligned wire strands (21), each wire having an acutely angled end surface (22) for mating with another electrical contact, said contact wires being an integral part of and continuous with the wires of said conductor in a rear portion (R). Preferably, the wires in the forward portion of the conductor are held radially together by a sleeve or holder which is inserted over the forward end, around the wires and crimped in place, separating the rear portion (R) of the conductor, which generally has insulation (30) around the conductor for a portion of its length from the forward contact portion.

6 Claims, 17 Drawing Figures

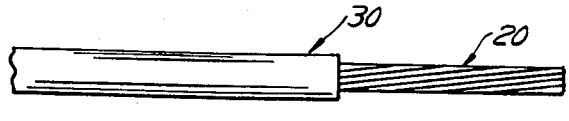
FIG. 1
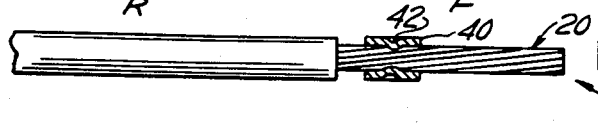
FIG. 2
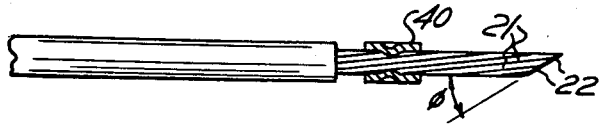
FIG. 3
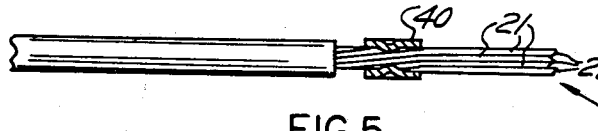
FIG. 4
FIG. 5
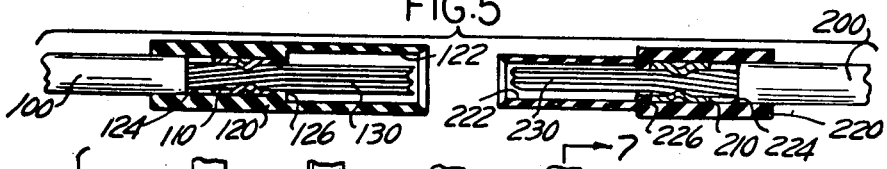
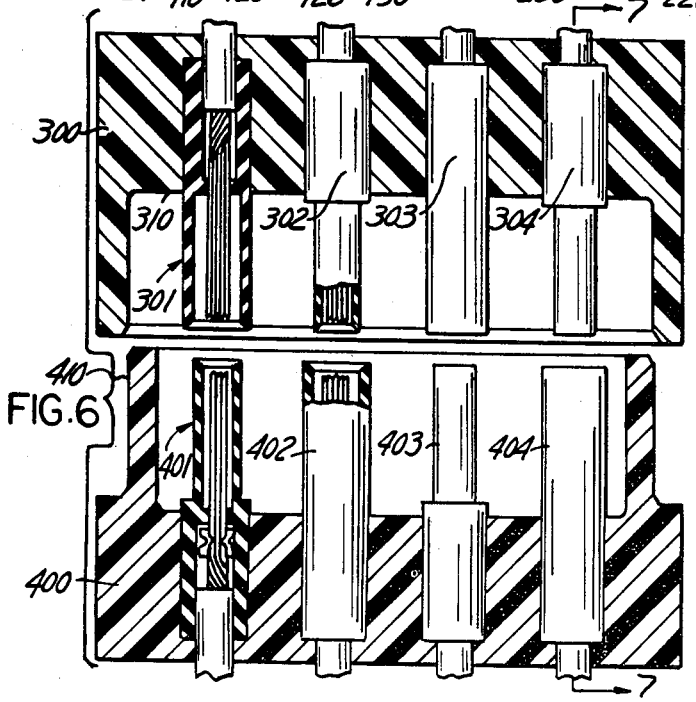
FIG. 6
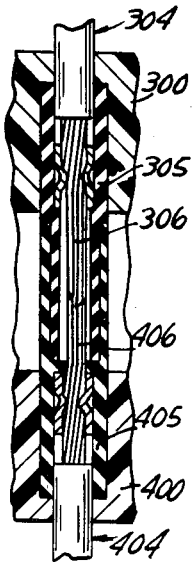
FIG. 7

ELECTRICAL CONDUCTOR HAVING AN INTEGRAL ELECTRICAL CONTACT

This is a division of application Ser. No. 90,198, filed Nov. 1, 1979, now abandoned which is a division of application Ser. No. 890,339, filed Mar. 27, 1978, now U.S. Pat. No. 4,206,958.

TECHNICAL FIELD

The present invention relates to electrical conductors. More particularly, the present invention relates to an electrical conductor having an integral electrical contact as a termination on at least one end thereof, said contact being suitable for mating with another contact. The present invention is also a novel method of making such a conductor.

BACKGROUND ART

Electrical conductors are well known in the prior art and have been in use for many years. Such prior art electrical conductors typically have a termination on at least one end thereof to connect the conductor with another electrical element. Such a termination typically has been obtained by coupling a separate piece (a contact) to the conductor. This disadvantageously necessitated the separate manufacture and inventory of separate contacts and the installation of such a separate contact to the conductor in order to couple the contact with the conductor. Installation of the contact additionally required the preparation of the conductor to couple it with the contact. The separate manufacturing and storing in inventory steps and the preparation of the conductor adds undesirable expense to the process of manufacturing a conductor. The preparation and assembly requires either the time of the workman or of the machine, both of which add expense to the manufacturing process. Furthermore, the connection between a conductor and a contact is itself undesirable in that it adds electrical resistance to the circuit, where a lower resistance is usually desirable.

Furthermore, the making and assembling of separate pieces entails a multiple inspection of the individual pieces separately and then assembled. The additional pieces provide additional sources of potential failures and unacceptable products.

Prior art electrical conductor terminations "contacts" are sleeve like members having a forward mating portion and a rear wire receiving portion. An electrical conductor having a plurality of wires is connected to the respective wires in another conductor by inserting each wire into the wire receiving portion of a contact and then connecting the mating end of each contact on one conductor to respective contacts on another conductor. One such electrical contact is described in U.S. Pat. No. 3,725,844 to McKeown et al. for "Hermaphroditic Electrical Contact", a patent which is assigned to the assignee of the present invention. The contact described in that patent has acutely angled end surfaces for mating with a similar contact in electrical circuit relationship. Such a contact has limitations similar to the other contacts discussed above, in that the contact consists of several pieces, each separate from the conductor and assembly of the contact as well as the contact with the conductor is required. Further, the forward portion of the electrical conductor must be prepared for insertion within the sleeve.

DISCLOSURE OF THE INVENTION

The present invention is a novel electrical conductor having an integral electrical contact and a method of making the conductor. The novel conductor overcomes the undesirable features and limitations of the prior art conductors.

The apparatus of the present invention is especially suited for an electrical conductor in which a low manufacturing cost and a low electrical resistance is desired.

The electrical conductor (10) of the present invention includes a plurality of fine wire strands (21) which have their forward portions axially aligned and radially held together to form a "contact". The wires each have an acutely angled forward end portion (22). In one embodiment, (FIGS. 1–7) the "contact" is obtained by taking a multi-strand insulated wire (10), removing the insulation (30) from the forward portion (F) to expose the strands (21), cutting the exposed forward end portions of the strands to provide acutely angled ends (22), straightening the exposed forward portions of the strands (21) into axial alignment, then securing the conductor with a sleeve or holder (40) by inserting the holder over the forward portion and crimping it in place. The entire assembly is then assembled within one of a pair of mateable housing (120 or 220) which protect the forward contact portion (F) and arrange the contacts in predetermined relationship.

In another method of making the conductor of the present invention (FIGS. 8–11), a plurality of wires (500), each having a single central conductor (510) surrounded by insulation (520) is prepared with the forward portion free of the insulation and the end angled. The wires in the forward portion are secured together, preferably by a sleeve (550), to form a contact with the wires of the contact being the same wires in the rear insulated portion.

In another embodiment of the present invention (FIGS. 12–17), a plurality of strands (600) without insulation are individually insulated, except in the forward contact portion, with a suitable insulating finish (610) such as magnet wire varnish or Kapton brand insulation. This electrically insulates the strands rearwardly of the forward contact portion while allowing the forward contact portion to remain exposed to connect the strands with another conductor in electrical circuit relationship.

Other objects and advantages of the present invention will be apparent to one skilled in the art in view of the following description and claims and the accompanying drawings.

BRIEF DESCRIPTION OF THE DRAWINGS

FIG. 1 is a perspective view of an insulated multi-stranded conductor with the forward portion of the insulation removed to expose the conductor strands.

FIG. 2 is a perspective view of the conductor of FIG. 1 with a sleeve installed around the conductor in the forward portion.

FIG. 3 is a view of the conductor of FIG. 2 with the forward end portion of the stranded conductor cut at an acute angle.

FIG. 4 is a view of the conductor of FIG. 3 with the forward portion of the strands of the conductor straightened generally into axial alignment.

FIG. 5 is a partial cross-sectional view of an electrical connector assembly having two electrical connector halves which are mateable together, each half employing a plurality of conductors of the type described in FIGS. 1–4 shown prior to the assembly of the connector halves.

FIG. 6 is a partial cross-sectional view of several electrical connector assemblies (of the type shown in FIG. 5) mounted in connector housings or bodies.

FIG. 7 is a cross-sectional view of a portion of FIG. 6, looking in the direction of line 7—7, showing after the mating of the connector bodies and assemblies of FIG. 6.

DETAILED DESCRIPTION OF THE DRAWINGS

Figure 8:
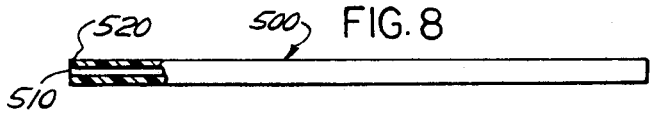
FIG. 8 is a partial cross-sectional view of an insulated wire or conductor having a single conductive strand.

FIG. 1 shows an insulated conductor or wire 10 which has a central stranded conductor 20 with electrical insulation 30 surrounding the conductor in a rear portion R. The insulation in a forward portion F of the wire 10 has been removed to expose the stranded conductor 20, which typically has several spirally-wound strands of copper or copper-weld (carbon steel core with copper plating) or copper alloy or stainless steel. The best material is believed to be copper-weld for rigidity and conductivity and relatively low expense.

FIG. 2 shows the insulated wire 10 of FIG. 1 with a sleeve or holder 40 inserted over the forward portion F of the central stranded conductor 20. The holder 40 is held in place by an inward crimp 42 where the sleeve 40 has been crimped into the conductor 20.

FIG. 3 shows the insulated wire 10 and the sleeve 40 of FIG. 2 with the forward end of the wire cut to an acute angle $\theta$. The cutting of the spirally wound conductor 20, because of the spiral winding, results in individual strands 21 being of different lengths and each strand may have an end surface 22 with an angle which differs from the angle on the end surface on other strands. Preferably, all of the individual strands have an acutely angled, or tapering, end surface which assists in mating and in electrical characteristics. The acutely angled end surfaces are more fully described in U.S. Pat. No. 3,725,844 which is incorporated herein by reference.

FIG. 4 shows the insulated wire 10 of FIG. 3 with the individual wire strands 21 straightened into axial alignment in the portion of the strands forward of the sleeve 40. The wire strands 21 in a prototype or small scale production might be straightened manually with hand tools such as pliers; however, in high scale production the wire strands 21 would preferably be straightened using automated equipment to comb the wire strands into a straight, axial aligned configuration, then urged together radially to form a close bundle. The end surfaces 22 of the individual strands extend slightly differing lengths and have somewhat diverse angled end surfaces. The aligned strands are resiliently deflectable in the radial direction as they are adapted to be mated and unmated with a similar or identical type contact.

FIG. 5 shows portions of two wires or conductors 100, 200 prepared in the manner shown in FIGS. 1–4 and the accompanying description. The conductor 100 has a sleeve 110, which is mounted in a housing 120 and wire strands 130. The housing 120, which is made of a thermoplastic material or other suitable insulator, serves as protection for the wires before assembly and, after assembly into an electrical connection, serves to insulate the electrical connection from the environment. The sleeve 110 which is preferably metallic, also is insulated by the housing 120 from the environment. The housing 120 is provided with a forward bore 122, a rear bore 124 and a passage 126 connecting the bores 122, 124. The rear bore 124 is large enough to receive the holder 110 and the wire 100 even in the insulated region; the passage 126 is of a size small enough to prevent the holder 110 from passing through, but large enough to allow the wire strands 130 to pass therethrough.

The conductor 200 has a sleeve 210, which is mounted in a housing 220, and wire strands 230. The housing 220 is similar to the housing 120, having a forward bore 222, a rear bore 224 and a passage 226, except that the forward end of the housing 200 is of a smaller size than the bore 122 of the housing 100 to allow the external portion 228 to fit within the bore 122, allowing the mating of the strands 130 with the strands 230 to connect the conductors 100, 200 in electrical circuit relationship. When connected, the conductors 100, 200 form a single mated line or electrical connection.

The housing 120 thus has a larger sleeve portion at its forward or mating region and the housing 220 has a smaller sleeve portion at its mating region. The smaller sleeve portion is adapted to interfit within the larger sleeve portion upon mating.

FIG. 6 illustrates the use of a plurality of conductor assemblies 301–304 and 401–404 of the present invention. The conductor assemblies 301–304 are mounted to a body 300 and each include a conductor adapted to be mated with a conductor in respective conductor assemblies 401–404, which are mounted to a second body 400. The bodies 300, 400 have a plurality of generally parallel passages for receiving the conductor assemblies. For ease in manufacturing and lower expense, the bodies 300, 400 are preferably made of plastic, although metal or other materials might be used, as the conducting wires are insulated from the bodies by the sleeves which are nonconducting. As shown in FIG. 6, the conductor assemblies are arranged with alternating larger and smaller sleeves.

The body 300 has an undercut 310 and the body 400 has a forward projection 410 adapted to fit within the undercut 310 when bodies 300, 400 are mated.

FIG. 7 illustrates the mating of the conductor assembly 304 mounted to the body 300 with the conductor assembly 404 mounted to the body 400. The conductor assembly 304 includes a housing 305 which fits within a housing 405 of the conductor assembly 404. Wire strands 306 associated with the assembly 304 mate in electrical circuit relationship with wire strands 406 associated with the assembly 404.

FIG. 8 is a partial cross-sectional view of an insulated wire or elongated electrical conductor 500 which has a single central conductor strand 510 surrounded by insulation 520.

Figure 9:
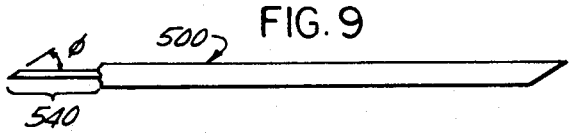
FIG. 9 is a perspective view of the wire of FIG. 8 after being cut and the forward insulation is removed.

FIG. 9 is a view of the wire 500 of FIG. 8. The insulation 520 has been removed from a forward end portion of the electrical conductor 500 to expose an end portion 540 of the strand 510, the end surface thereof being cut to an acute angle $\phi$ for mating. If desired, the rearward end portion may also be prepared in a similar fashion; however, other methods of conductor termination might also be employed to advantage. The angle $\phi$ is preferably about 30°, although angles as large as 45° might be used to advantage.

Figure 10:
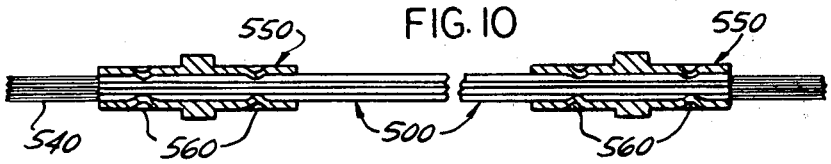
FIG. 10 is a cross-sectional view of a plurality of wires of the type shown in FIG. 9 and assembled into a conductor and secured together at each end with a sleeve.

FIG. 10 is a view of a plurality of discrete electrical wires or elongated electrical conductors 500 having their opposite ends held within a sleeve 550 by crimps 560. The forward end portions 540 of each exposed conductor 500 and acutely angled end surface thereof form a mateable bundle and extend beyond the sleeve 550 at each end of the wires 500.

Figure 11:
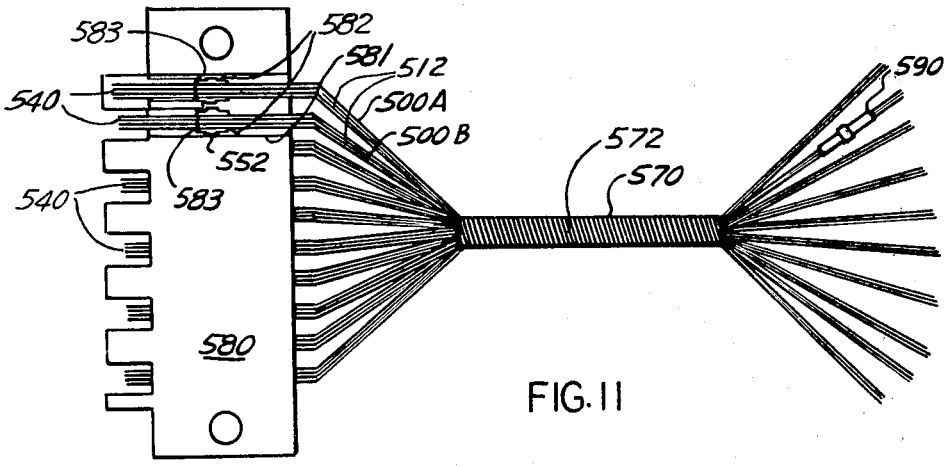
FIG. 11 is a partial cross-sectional view of a cable assembly including a plurality of conductors of the type described in FIG. 10.

FIG. 11 illustrates an electrical cable assembly comprising a plurality of elongated conductors 500 with their insulated medial portions being assembled into a multi-conductor cable 570. Preferably, the cable 570 includes a metal conduit 572 which is helically wound to provide a crush-proof flexible encapsulation providing maximum protection for the cable with a minimum outside diameter, to protect against hostile environments. In more controlled environments, the multiple conductors might be assembled into the cable 570 by an electrical tape or other suitable securing material. The electrical conductors 500 extend outwardly from conduit 572 to expose insulated end portions 512 of each conductor, the insulated end portions of each wire 500 including the exposed conductive end portion 540. A plurality of separated cable-like assemblies, such as shown by 500A, 500B, are provided by groups of individual electrical conductors 500 being gathered together into bundles, each group forming one of the respective separated cable-like assemblies.

The insulated end portions 512 comprising each cable-like assembly 500A, 500B are fitted into like sleeves 550, each sleeve 550 being crimped about its associated assembly with each cable-like assembly 500A, 500B then being mounted to a molded, multi-passage body 580 which has a plurality of parallel passages 581. Associated with each passage is a contact retention cone 582 which is positioned to secure the holder 550 in place within the passage 581 by engaging one side of an enlarged shoulder 552 of the holder 550. The other side of the shoulder 552 sits against a stop 583 associated with each passage. Such contact retention systems are more fully described in two pending patent applications, Ser. Nos. 728,820 and 728,821 of N. C. Bourdon et al entitled "Electrical Connector With Front Rear Insertable Removable Contacts" and "Molded Electrical Connector Insert", respectively, both of which are incorporated herein by reference.

A sleeve 590 has been inserted over the other end of one of the conductors 550. The other ends may have similar terminations or a termination chosen from any of the suitable electrical terminations, depending upon the use of the cable 570.

Figure 12:
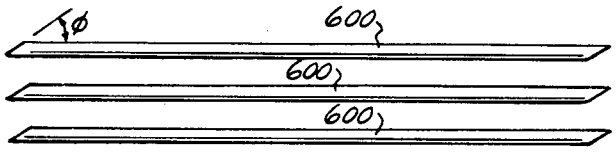
FIG 12 is a perspective view of three uninsulated wire or conductor.

FIG. 12 illustrates three uninsulated (bare) straight strands 600 of an electrical conductor which, considering both good performance and low cost, is preferably a high strength stainless steel (hard drawn 303 stainless steel). Other materials such as copper-weld-type steel or a carbon steel core, copper clad wire could be used, as could other metals and alloys which have low cost, good conductivity, high strength, resilient and with friable oxides. Such additional metals and alloys include berylium copper or other known materials.

The strands 600 have been cut to the desired length and have been cut with an acute angle $\phi$ on the ends. The angle $\phi$ is preferably 30°.

Figure 13:
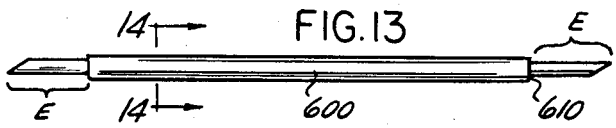
FIG. 13 is a perspective view of one of the conductors of FIG. 12 after coating with an insulating material.

FIG. 13 is a view of one conductor strand 600 coated with an effective amount of an electrically insulating material 610, except in end portions E. The insulating material is preferably magnet wire varnish such as is sold under the trademark Kapton.

Figure 14:
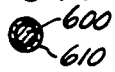
FIG. 14 is a cross-sectional view of the conductor of FIG. 13, looking along the line 14—14 in direction of the arrows.

FIG. 14 is a cross-sectional view of the conductor strand 600 showing a thin coating of the insulating 610.

Figure 15:
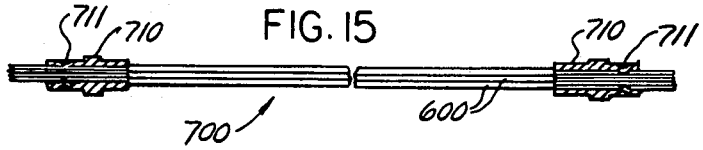
FIG. 15 is a fragmented view of a conductor made from a plurality of wires of the type shown in FIG. 13.

FIG. 15 is a view of a conductor 700 including a plurality of conductor strands 600 prepared as described in FIGS. 12–14 and assembled in axial alignment, with end surfaces extending approximately a uniform distance. A sleeve 710 has been inserted over the end portions of the plurality of strands 600 and held in place by a radial crimp 711 which secures the wires together in a tight bundle.

Figure 16:
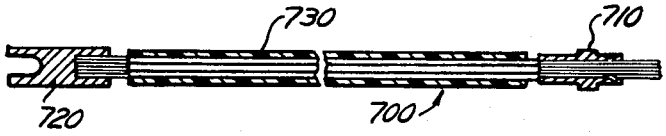
FIG. 16 is a fragmented view of a conductor made from a plurality of wires of the type shown in FIG. 13, similar to that of FIG. 15 with a different type of termination at one end thereof.

FIG. 16 shows a conductor 700 similar to FIG. 15. At one end of the conductor, a conventional electrical termination 720 rather than a brush-type contact is attached to the conductor 700 either by solder or a crimp (depending on the application). Additionally, an optional casing 730 of electrically insulating material has been applied around the bundle of wire strands between the sleeve 710 and the termination 720, eliminating in some instances the requirement that the individual strands of wire be separately insulated.

Figure 17:
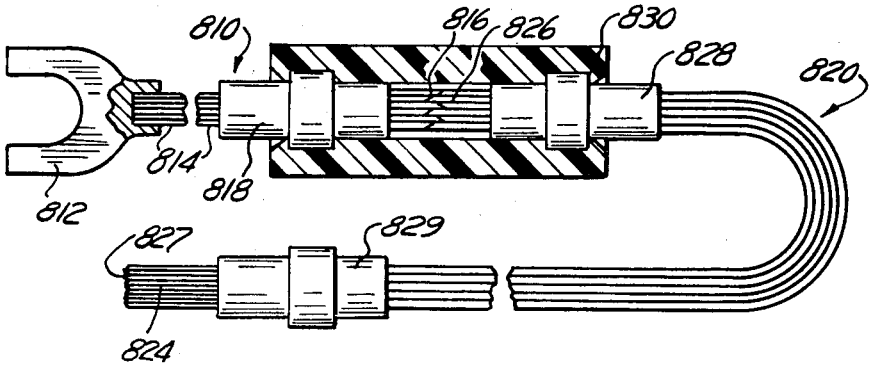
FIG. 17 is a cross-sectional view of an electrical connection between two conductors similar to the conductor shown in FIG. 16.

FIG. 17 illustrates a connection of a first conductor 810 with a second conductor 820 in electrical circuit relationship. The first conductor 810 includes a conventional termination 812, and a plurality of conducting strands 814 which terminate in acutely angled end surfaces 816, held radially together by sleeve 818. The second conductor 820 includes a plurality of conducting strands 824 which terminate in acutely angled end surfaces 826,827 at the respective ends. The end surfaces 826,827 are held radially together by sleeves 828,829 respectively. The sleeves 818,828 are held within a housing 830 which is adapted to hold the sleeves so that the end surfaces 816 are mated with the end surfaces 826, with an electrical circuit relationship established between the end surfaces 827 and the termination 812.

Other objects and advantages of the present invention will be apparent to those skilled in the art in view of the foregoing description. The foregoing description accordingly should be considered as illustrative only and should not be interpreted to limit the scope of the present invention, which is defined by the following claims.

What is claimed is:

1. An electrical cable assembly of the type having wire strands formed into a bundle for releasable connection to another electrical contact formed of a bundle of wires having angled ends, comprising:

a plurality of elongated electrical conductors (500) of the type consisting of a strand (510) of conductive material surrounded by dielectric material (520), each strand having a conductive end portion (540) thereof exposed to extend from the dielectric material, the dielectric material otherwise electrically insulating each of the conductive strands (510) from one another;

protective means (572) medially disposed about the plurality of electrical conductors (500) for securing the electrical conductors into a multi-conductor cable, an insulated end portion (512) of each electrical conductor (500) containing its exposed conductive end portion (540) extending from said protective means;

a cable-like assembly (500A) comprising the insulated end portions (512) of the electrical conductors (500) being gathered together; and a sleeve (550) secured about said cable-like assembly, the exposed conductive end portions (540) so assembled forming a mateable bundle extending forwardly from the sleeve in axially aligned, parallel relation, the end of each conductive strand being acutely angled for mating, said angled ends of said strands and said mateable bundles being so configured that said mateable bundle and said another contact can be aligned along their axes and moved into releasable intermingled connection with the angled ends of each bundle entering the other bundle.

2. An electrical cable assembly of the type described in claim 1 wherein the sleeve (550) is secured by a crimp around the insulated end portions (512) in a predetermined location along the strands (510) to urge the conductive end portions (540) together into close contact in the vicinity of the sleeve crimp.

3. An electrical cable assembly according to claim 1 comprising a pair of cable-like assemblies (500A, 500B), each cable-like assembly comprising several of said plurality of electrical conductors (500) being gathered together to form, respectively, each cable-like assembly, a sleeve being secured about the insulated end portions of each cable-like assembly so that the respective conductive end portions extend from their respective sleeves in axially aligned, parallel relation, the end of each said conductive strand being acutely angled for mating.

4. An electrical cable assembly of the type described in claim 3 wherein the dielectric material is a rubber or plastic material which surrounds the plurality of electrically-conducting wires as a group.

5. An electrical cable assembly as described in claim 3, each respective cable-like assembly (500A, 500B) being of the type having their conductive wire strands formed into a bundle for releasable connection to another electrical contact formed of a bundle of wires having angled ends, the exposed conductive end portions of each said cable-like assembly being mateable with their respective another electrical contact, each electrical contact including a plurality of fine conductive wires held together in a bundle and each wire having an acutely-angled end portion with each said cable-like assembly (500A, 500B) conductive end portions being configured to be aligned and moved into releasable intermingled contact with the plurality of fine bundle wires.

6. A cable of the type described in claim 1 wherein the sleeve has an external shoulder for being held within a receiving structure.

* * * * *